US008886068B2

(12) United States Patent
Inoue et al.

(10) Patent No.: US 8,886,068 B2
(45) Date of Patent: Nov. 11, 2014

(54) IMAGE FORMING APPARATUS WITH TRANSFER VOLTAGE CONTROL

(75) Inventors: Naoki Inoue, Yokohama (JP); Masaki Shimada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 13/275,035

(22) Filed: Oct. 17, 2011

(65) Prior Publication Data

US 2012/0099880 A1 Apr. 26, 2012

(30) Foreign Application Priority Data

Oct. 20, 2010 (JP) ..... 2010-235562

(51) Int. Cl.
*G03G 15/16* (2006.01)
*G03G 15/00* (2006.01)

(52) U.S. Cl.
CPC ..... *G03G 15/1645* (2013.01)
USPC ..... 399/66; 399/43

(58) Field of Classification Search
USPC ..... 399/66, 43
See application file for complete search history.

(56) References Cited

U.S. PATENT DOCUMENTS

2003/0215251 A1* 11/2003 Mochizuki et al. ..... 399/66 X

FOREIGN PATENT DOCUMENTS

| | | | |
|---|---|---|---|
| JP | 05-006112 | A | 1/1993 |
| JP | 5-6112 | A | 1/1993 |
| JP | 08-276616 | A | 10/1996 |
| JP | 2001109281 | A | 4/2001 |
| JP | 2002131679 | A | 5/2002 |
| JP | 2002-328545 | A | 11/2002 |
| JP | 2004013027 | A | 1/2004 |

* cited by examiner

*Primary Examiner* — Sophia S Chen
(74) *Attorney, Agent, or Firm* — Canon USA, Inc. IP Division

(57) ABSTRACT

The present invention is directed to realizing a suitable electrical setting of a transferring unit as well as calculating the setting earlier than a conventional method. To achieve this, an image forming apparatus performs forcible light emission at an activation of a laser beam and automatic transferring voltage control (ATVC) concurrently. Then the image forming apparatus further corrects a result obtained by the ATVC during the forcible light emission and performs suitable electrical setting of a transferring unit.

20 Claims, 9 Drawing Sheets

IMAGE FORMING APPARATUS WITH TRANSFER VOLTAGE CONTROL

BACKGROUND OF THE INVENTION

1. Field of the Invention

The present invention relates to an image forming apparatus using an electrophotographic method, e.g., a semiconductor laser printer.

2. Description of the Related Art

Japanese Patent Laid-open Publication No. 05-6112 discusses an image forming apparatus in which, when an image is not formed, a reference voltage to be applied to a transfer member when an image is formed is set (hereinafter referred to as automatic transferring voltage control (ATVC)). More specifically, in the ATVC, a present transfer current value is detected to set a reference transferring voltage value at which the current value becomes a target value. A plural repetition of the above operation sets a suitable transfer output voltage when an image is formed.

Now, control sequence of the ATVC is described below with reference to FIG. 9. After a scanner motor is started to be driven, the semiconductor laser is continuously or intermittently forced to be lighted up (hereinafter referred to as forcible light emission) to detect a rotation speed of the scanner motor by a light-receiving sensor provided over a laser scanning line. According to the above detection, when a polygon mirror comes to be constantly rotated, the semiconductor laser repeats a light up and a light out alternately according to a synchronization signal input into the light-receiving sensor (hereinafter referred to as unblanking luminescence) so as not to cause the semiconductor laser to irradiate onto a surface of a photosensitive member (i.e., image area). Subsequently, after the processing is shifted to the unblanking luminescence, the ATVC is executed.

When a toner image is actually transferred, a case where an exposed portion of the photosensitive drum does not come into contact with (reach) a transfer nip portion is determined as a reference state and the transferring voltage value is set so as to be adjustable based on the reference transferring voltage value set with respect to the reference state. For example, in a case where a recording medium that receives a toner image heads into the next transfer nip portion, the transferring voltage value after the recording medium heads into the transfer nip portion is set with reference to the transferring voltage value (i.e., reference transferring voltage) in a state before the recording medium heads into the transfer nip portion. For the reason described above, the image forming apparatus normally performs the ATVC after shifting a control to the above described unblanking luminescence.

In the recent image forming apparatus, reduction of a first print out time before a first page of a print product is discharged after a print instruction is received is increasingly demanded. In association therewith, an early completion of the above described ATVC is also demanded. For example, in the ATVC control illustrated in FIG. 9, if the ATVC is started at the same time the printing is started, the above demand can be realized.

In a charged surface of the photosensitive member, potentials change between a case of a surface of the photosensitive member on which the semiconductor laser is forcibly emitted and a case of a surface of the photosensitive member subjected to an unblanking luminescence and thus current values flowing through a transfer member contacting the photosensitive member also change. More specifically, if the ATVC is performed while the semiconductor laser is forcibly emitted, the above described potential change (i.e., change of the transfer current value flowing through the transfer member) occurs, which reduces accuracy of the ATVC. Alternatively, a set value itself obtained in the ATVC becomes an improper value.

On the other hand, a method in which the current value is set with respect to the target voltage value is also known as a transferring method in the image forming apparatus in addition to a method in which the voltage value is set with respect to the target current value. The above described problems also occur in this case.

SUMMARY OF THE INVENTION

The present invention is directed to an image forming apparatus capable of realizing a suitable electrical setting of a transferring unit as well as calculating the setting earlier than the conventional method.

According to an aspect of the present invention, in an image forming apparatus including a light emitter configured to emit a light beam, a polygon mirror configured to scan a surface of a photosensitive member that is charged with the light beam emitted from the light emitter by a charging unit to form an electrostatic latent image on the photosensitive member, a detector configured to detect the light beam to be used in scanning by the polygon mirror, a developer unit configured to visualize a toner image by causing a toner to adhere to an electrostatic latent image formed on a surface of the photosensitive member, a transferring unit configured to transfer the toner image to a transferred medium, a transferring voltage applying unit configured to apply a transferring voltage to the transferring unit, and a transferring controller configured to detect a current flowing through the transferring unit according to the application of the transferring voltage to determine the transferring voltage to be applied to the transferring unit based on the detection result, the image forming apparatus further comprises a measuring unit configured to cause the light emitter to forcibly emit continuously through an image region and a non-image region of the photosensitive member when the polygon mirror is activated to measure a speed of the polygon mirror based on a detection cycle of the detector, wherein the transferring controller further corrects the transferring voltage at which detected current becomes a target current to determine a reference transferring voltage, or, alternatively, corrects the detected current to determine transferring voltage at which the corrected current becomes the target current as a reference transferring voltage in a state that the light emitter is forcibly emitted when the polygon mirror is activated, such that a difference of each of the detected currents when an exposed portion and an unexposed portion of the photosensitive member reach the transfer nip portion is eliminated.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A first exemplary embodiment is described below. Components described in the present exemplary embodiment are mere examples and thus do not limit the scope of the present invention.

Figure 1:
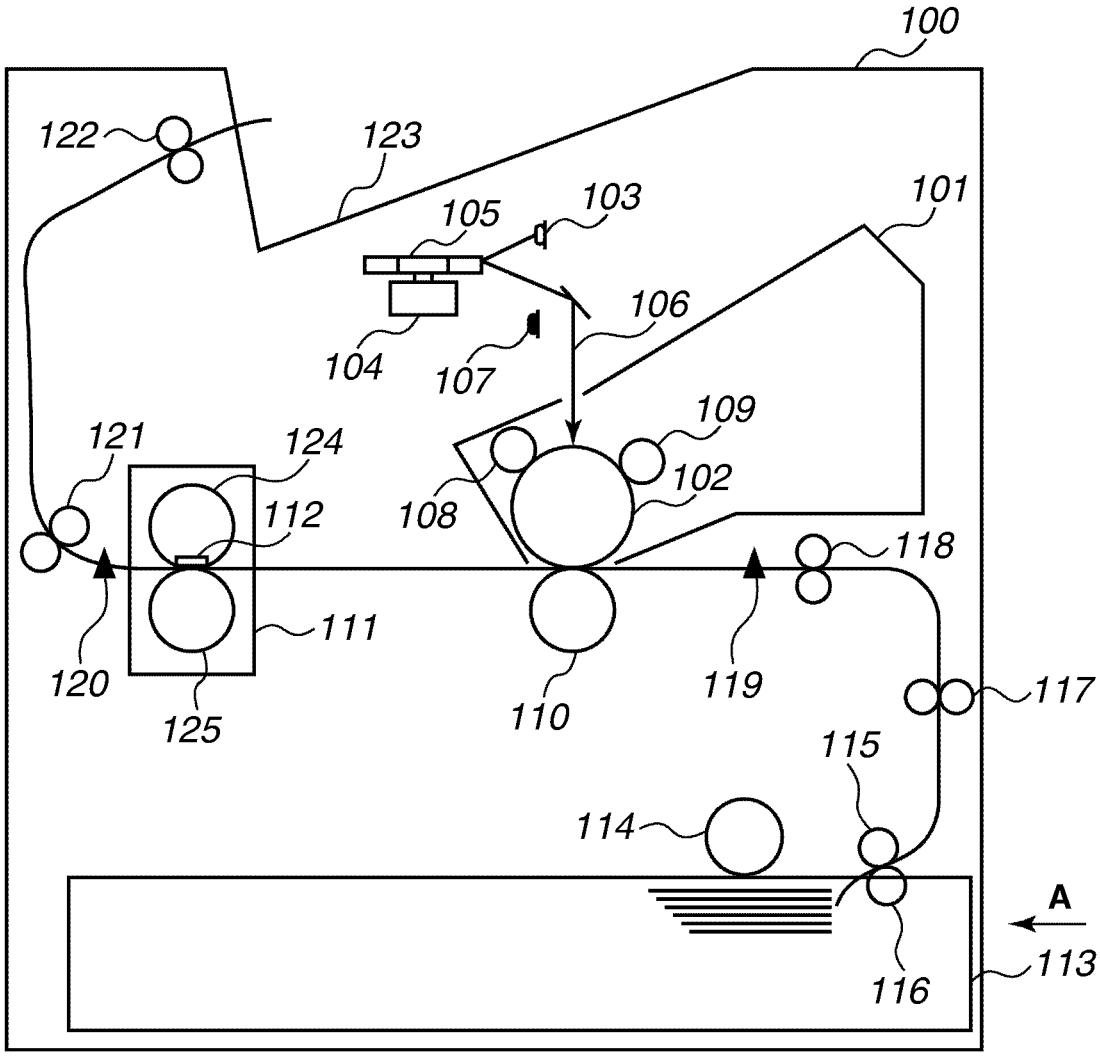
FIG. 1 illustrates a cross sectional view of the entire image forming apparatus.

A description is made below as to a cross sectional view of an image forming apparatus. A specific example of the image forming apparatus of the present invention is described below with reference to the drawings attached hereto. FIG. 1 is a schematic view illustrating an entire configuration of the image forming apparatus according to the present exemplary embodiment. FIG. 1 illustrates an image forming apparatus main body 100. A toner cartridge 101 is detachably attached to an image forming apparatus. A photosensitive member 102 functions as an image carrier. A semiconductor laser 103 functions as a light source. The semiconductor laser 103 emits a light beam. A polygon mirror 105 is rotated by a scanner motor 104. A laser light path 106 is headed from the semiconductor laser 103 to scan over the photosensitive member 102. A light-receiving sensor 107 receives the laser emitted from the semiconductor laser 103. A charging roller 108 uniformly charges over a surface of the photosensitive member 102. A development unit 109 develops to visualize an electrostatic latent image by causing a toner to transfer onto (i.e., by developing) the electrostatic latent image formed on the photosensitive member 102.

A transferring roller 110 transfers a toner image developed by the development unit 109 onto a predetermined recording paper (i.e., transferred medium). A fixing device 111 includes a fixing heater 112 for fusing the toner transferred onto the recording paper by heating. The fixing device 111, by using the fixing heater 112, fixes the toner on the recording paper by heating and pressurizing while the recording paper is conveyed by a fixing film 124 and a pressure roller 125. A sheet cassette 113 for storing sheets is mounted to the printer 100 from a direction of an arrow A of FIG. 1. A paper feed roller 114 conveys a sheet from the sheet cassette 113 into a conveyance path with a single rotation. A feed roller 115 and a retard roller 116 separate a plurality of sheets each other to send out the sheets one by one toward the conveyance path in a case where a plurality of sheets are picked up by the paper feed roller 114 as a pick-up roller. An intermediate roller 117 conveys a sheet fed from the sheet cassette 113 toward an image forming unit. A pretransferring roller pair 118 sends the conveyed sheet out toward the photosensitive member 102. With respect to the conveyed sheet, a top sensor 119 synchronizes an image writing (i.e., recording/printing) onto the photosensitive member 102 with the sheet conveyance as well as measures a length of the conveyed sheet in a conveyance direction. A fixing sensor 120 detects presence or absence of the sheet after an image is fixed. A conveyance roller 121 discharges the sheet after an image is fixed toward a paper discharge conveyance path. A discharge roller 122 discharges the sheet to a discharge tray 123 where discharged sheets are stacked.

In FIG. 1, the image forming apparatus that performs a monochrome printing, but not limited thereto, is exemplified. For example, the below described control of each exemplary embodiment is applicable also to the transferring processing in a color image forming apparatus in which toner images of Y (yellow), M (magenta), C (cyan), and K (black) having been developed on the respective corresponding photosensitive drums are directly sequentially transferred to a recording sheet (i.e., transferred medium) and the toner images are fixed onto the recording sheet. Further, for example, a control described in each exemplary embodiment is applicable to the primary transfer processing in the color image forming apparatus in which the toner images of the colors of Y, M, C, and K are preliminarily transferred onto an intermediate transfer belt (i.e., transferred medium) so as to overlap the toner images one another and the overlapped toner images are secondarily transferred onto the recording medium.

Figure 2:
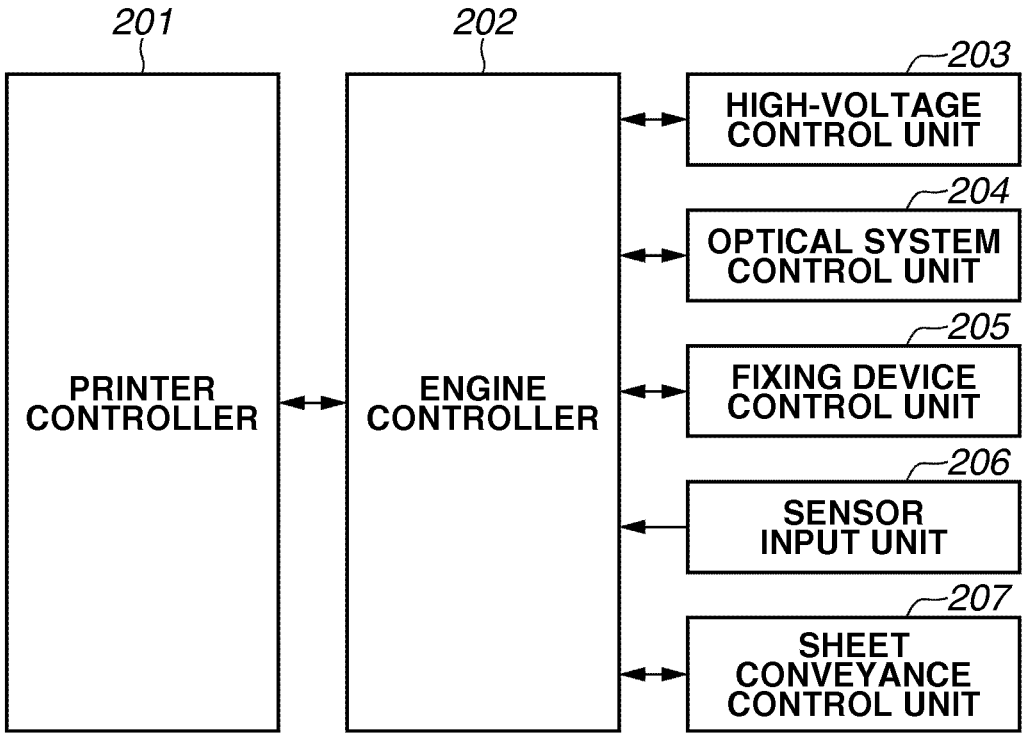
FIG. 2 is a block diagram of the image forming apparatus.
Figure 3:
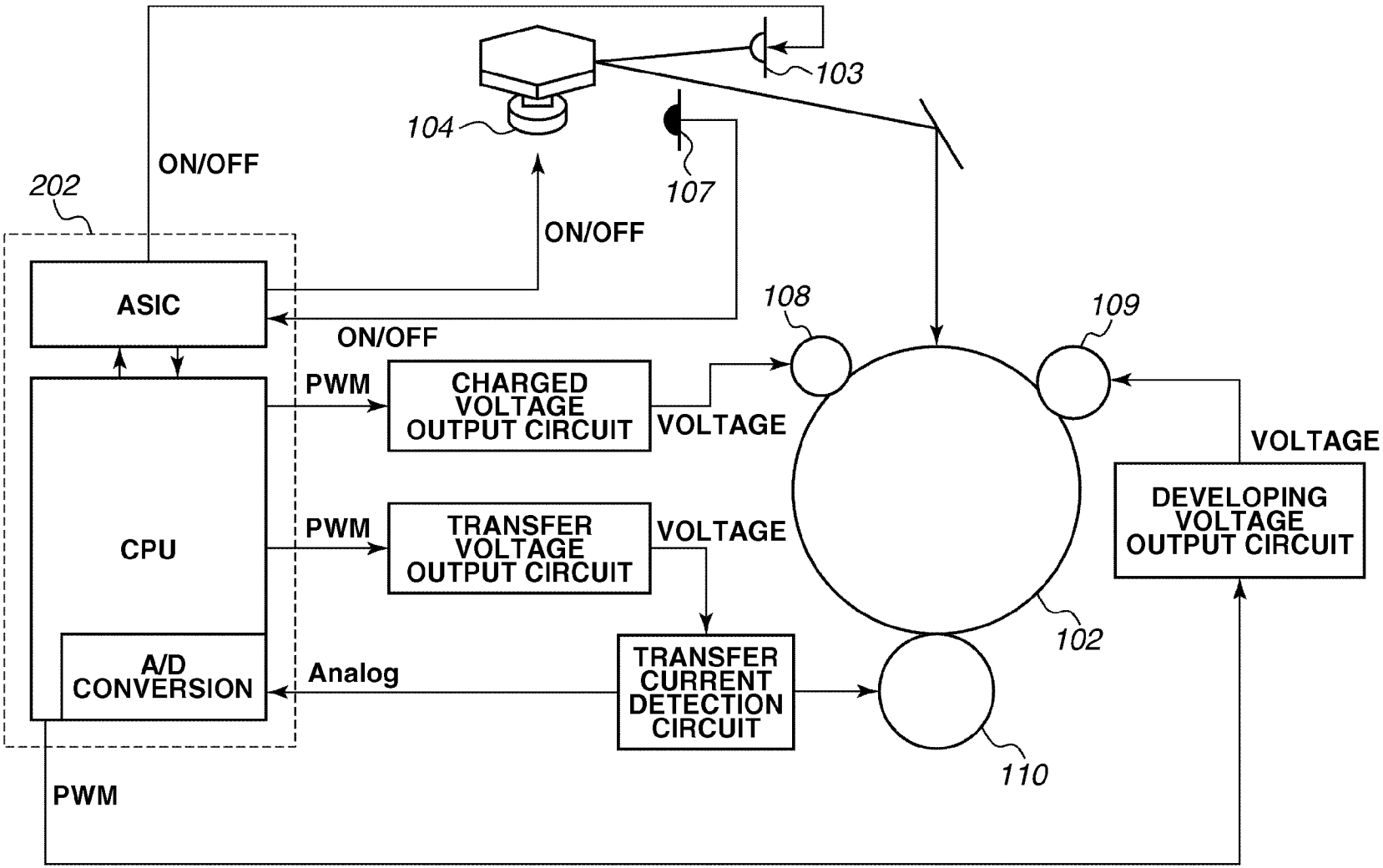
FIG. 3 illustrates a relationship between an engine controller and each unit of the image forming apparatus.

A description is made below as to a block diagram of the image forming apparatus. FIG. 2 is a block diagram illustrating a circuit configuration in the present invention. In FIG. 2, a printer controller 201 renders image code data transmitted from an external device such as a host computer (not illustrated) into bit data necessary for printing in the printer. The printer controller 201 also reads inside information of the printer to display it. An engine controller 202 controls a print operation of each unit of the printer engine according to an instruction of the printer controller 201. The engine controller 202 further notifies the inside information of the printer to the printer controller 201. The engine controller 202 includes a central processing unit (CPU) including a firmware and an application specific integration circuit (ASIC), as shown in FIG. 3 and described below. The printer controller 201 and the engine controller 202 may be constructed in a common CPU and ASIC.

A high-voltage control unit 203 performs a high-voltage output control in each processing, such as charging processing, developing processing and transferring processing, according to an instruction of the engine controller 202. An optical system control unit 204 drives/stops the scanner motor 104 and controls a speed of the scanner motor 104 including measurement of the speed thereof. The optical system control unit 204 further controls lighting of the laser beam according to an instruction of the engine controller 202. A fixing device control unit 205 drives/stops energization to the fixing heater according to an instruction of the engine controller 202. A sensor input unit 206 notifies to the engine controller 202 a detection result of the top sensor 119, a detection result of the fixing sensor 120, and a presence or absence of a sheet detected by a sheet surface position sensor (not illustrated), as well as a temperature detected by a below described temperature detection element. A sheet conveyance control unit 207 drives/stops a motor/roller for the purpose of conveyance of a recording paper according to an instruction of the engine controller 202. The sheet conveyance control unit 207 controls driving/stopping of the paper feed roller 114, the feed and retard roller pair 115 and 116, the pretransferring roller 118, the photosensitive member 102, the fixing film 124, the pressure roller 125, the conveyance roller 121, and the discharge roller 122.

A relationship between the engine controller 202 and each unit of the image forming apparatus is described below. FIG. 3 illustrates a relationship between the engine controller 202 and each unit of the image forming apparatus used in the present exemplary embodiment.

The CPU included in the engine controller 202 transmits a pulse width modulation (PWM) signal to a high-voltage output circuit of each of the charging roller 108, the development unit 109, and the transferring roller 110. A boost transformer in each high-voltage output circuit (i.e., charged voltage output circuit, developing voltage output circuit, and transferring voltage output circuit) applies a high-voltage according to the input PWM signal to each high-voltage output unit. When the CPU causes a duty ratio of the PWM signal to change, the high-voltage applied to each high-voltage output unit changes.

The transferring voltage output circuit (i.e., transferring voltage application circuit) is connected to the transfer current detection circuit at which a current flowing through the transferring roller 110 is converted to a voltage. An analog signal is input into the CPU to be converted into a digital value by an analog to digital (A/D) converter in the CPU. The CPU can recognize the current flowing through the transferring roller 110 by the digital value. An amount of the current flowing through the transferring roller 110 is determined actually depending not only on an effect of the transferring roller 110 but also on an effect of the photosensitive member 102. A means for detecting the current flowing through the transferring roller 110 may be, as a matter of course, any other method in addition to the above described method.

The ASIC in the engine controller 202 controls a rotation speed of the scanner motor 104 and on/off of the semiconductor laser 103. The CPU can set a lighting method of the semiconductor laser 103 with respect to the ASIC. Examples of the lighting method to be set include a light out, a forcible light emission, an unblanking luminescence and a VIDEO lighting according to a signal transmitted from the printer controller 201. The forcible light emission means a lighting of the laser beam continuously performed in a non-image area as well as in an image area in at least a single laser scanning (or a plurality of laser scanning) as it is illustrated in a timing chart of, for example, FIG. 5 described below. Also, the forcible light emission means a continuous lighting of the laser beam while the polygon mirror having n-surfaces rotates at least by (1/n) rotation (or a plurality of rotations). The CPU sets a target rotation speed of the scanner motor 104 and instructs driving of the scanner motor 104 with respect to the ASIC. Activation of the scanner motor 104 corresponds to activation of the polygon mirror. The ASIC, after receiving the driving instruction, causes the rotation speed of the scanner motor 104 to accelerate or decelerate according to a lighting cycle input from the light-receiving sensor 107 to control the scanner motor so as to bring it at the target rotation speed. A certain value may be assigned to the target rotation speed. Alternatively, a certain acceptable range may be assigned to the target rotation speed.

Figure 4:
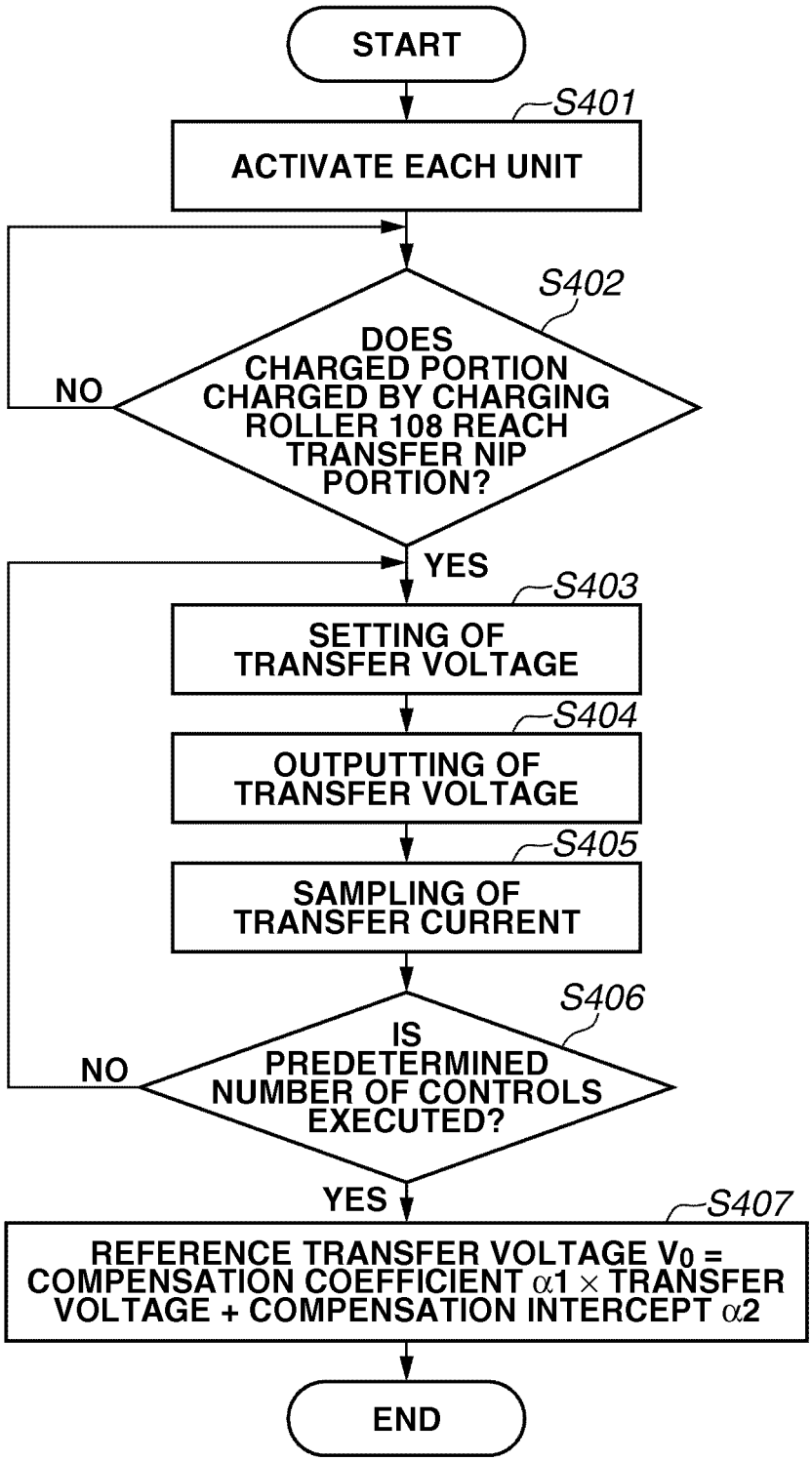
FIG. 4 is a flow chart illustrating an operation including an ATVC when the image forming apparatus is activated.

A description is made below as to a flow chart of an initial operation including the ATVC. FIG. 4 is a flow chart illustrating the ATVC processing performed in a state that the semiconductor laser 103 is forcibly emitted, the exposed portion is formed on the surface of the photosensitive member 102, and the exposed portion reaches the transfer nip portion. The flow chart is executed by the engine controller 202 that functions as a transfer control unit.

Figure 5:
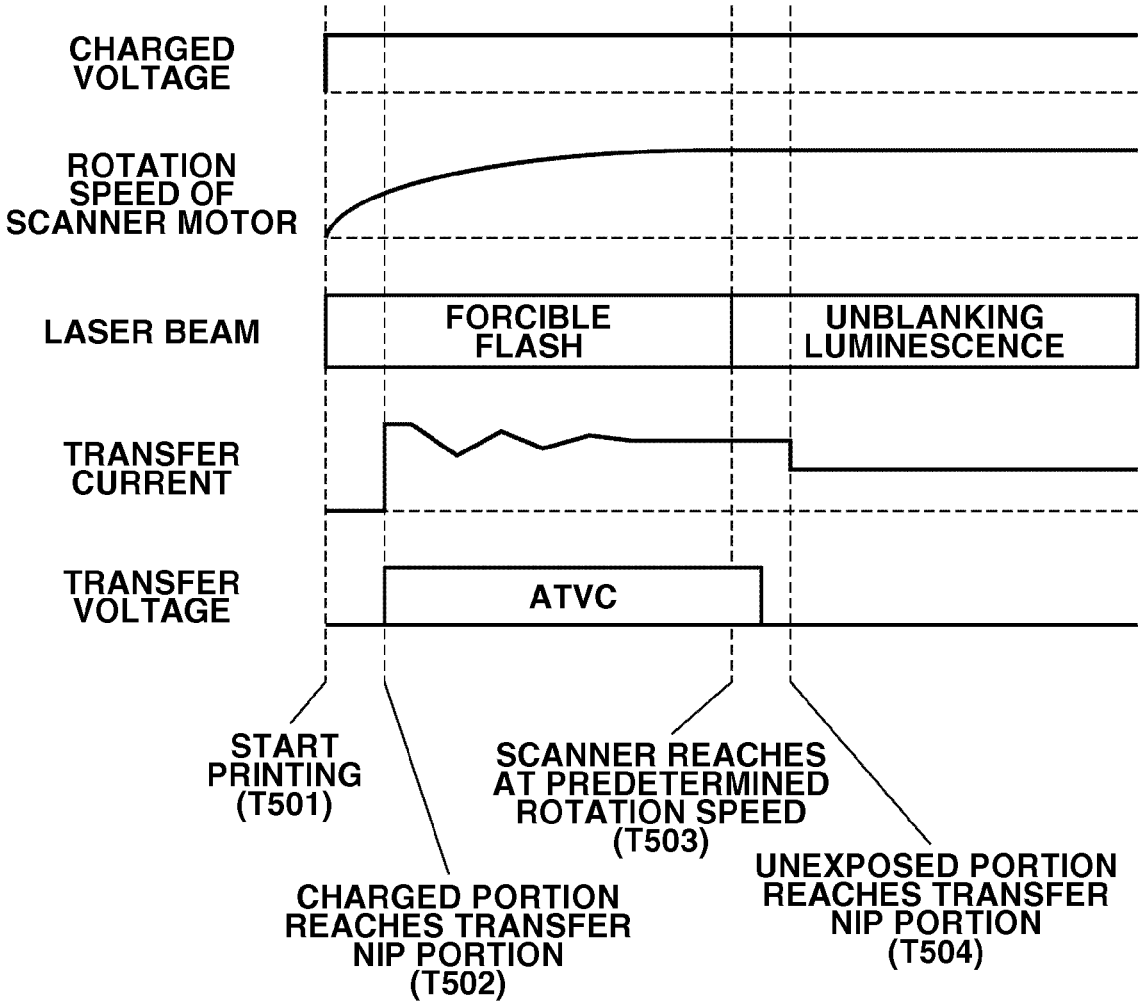
FIG. 5 is a timing chart of an initial operation including the ATVC.

In step S401, the engine controller 202 instructs a start of driving of the photosensitive member 102 and the scanner motor 104 when the engine controller 202 receives a print start instruction from the printer controller 201. In step S401, the engine controller 202 further instructs a start of a high-voltage output of the charging roller 108 and a start of the forcible light emission of the semiconductor laser 103. In step S401, the engine controller 202 still further instructs a start of driving of the other members necessary for image formation. Timing T501 in a timing chart of FIG. 5 illustrates a state that various types of processing are caused to start.

In step S402, the ATVC is started at least after a certain time period before an applied portion (i.e., applied position) of the photosensitive member 102 at which a high voltage is applied by the charging roller 108 reaches, according to the rotation of the photosensitive member 102, the transfer nip portion constituted by the photosensitive member 102 and the transferring roller 110 has passed (YES in step S402). Timing T502 in the timing chart of FIG. 5 corresponds to the timing for starting the ATVC. The engine controller 202 issues an instruction for starting the ATVC. The ATVC is performed concurrently with the activation of the scanner motor 104 (i.e., polygon motor 105).

In step S403, the engine controller 202 sets the voltage of the transferring roller 110 to a present initial value. In step S404, the transferring roller 110 outputs a high-voltage according to the setting of step S403. In step S405, the engine controller 202 samples the current value flowing through the transferring roller 110 that outputs a high-voltage for a certain period of time. In step S406, the engine controller 202 changes the settings of the controls to repeat the predetermined number of controls.

If the current value resulting from the detection of step S405 is smaller than a target current value, the engine controller 202 sets the transferring voltage value higher in the next step S403. On the other hand, if the value resulting from the detection is higher than the target current value, the engine controller 202 sets the transferring voltage value lower in the next step S403. The above described predetermined number of controls is determined depending on how many times the processing from step S403 through step S405 can be repeated within a time period before the semiconductor laser 103 starts the unblanking luminescence. More specifically, the above described predetermined number of controls is determined depending on how many times the controls can be performed at a position at which the exposed portion having been subjected to the forcible light emission affects the detected current, i.e., within a time period that the exposed portion is in contact with the transfer nip portion. After repeating the predetermined number of controls (YES in step S406), in step S407, the engine controller 202 determines a reference transferring voltage value $V_0$ such that a compensation coefficient $\alpha 1$ is multiplied by the finally calculated transferring voltage value and a compensation intercept $\alpha 2$ is added thereto. The CPU of the engine controller 202 may calculate the reference transferring voltage value $V_0$. Alternatively, the engine controller 202 may calculate the reference transferring voltage value $V_0$ by using a table provided in the engine controller 202.

How to calculate compensation information is described below. Descriptions are made below as to the compensation coefficient $\alpha 1$ and the compensation intercept $\alpha 2$. The compensation coefficient $\alpha 1$ and the compensation intercept $\alpha 2$ are calculated by the following processing performed by the engine controller 202. Specifically, the charging roller 108 outputs a high voltage of a certain value and the engine controller 202 performs the ATVC in a state that the exposed surface, exposed to the forcible light emission of the semiconductor laser 103, of the photosensitive member reaches the transfer nip portion. Accordingly, the engine controller 202 calculates the transferring voltage value $V_{0L}$ in a manner as described in the flow chart of FIG. 4. Furthermore, the charging roller 108 outputs a high voltage of a certain value and the semiconductor laser 103 performs the unblanking luminescence and the engine controller 202 performs the ATVC in a state that the unexposed surface of the photosensitive member 102 reaches the transfer nipping unit. Accordingly, the engine controller 202 calculates the transferring voltage value $V_{0D}$. The engine controller 202 executes the above described processing under a plurality of environments. More specific examples are described below.

The target current value in the ATVC is set to, for example, 3 μA. It is assumed that the voltage value $V_{0L}$ in a case where the ATVC is performed involving the forcible light emission in a low-temperature-and-low-humidity environment is 1000 V and the voltage value $V_{0D}$ in a case where the ATVC is performed involving the unblanking luminescence is 1300 V, respectively. It is further assumed that the engine controller 202 calculates in a high-temperature-and-high-humidity environment that the voltage value $V_{0L}$ in a case where the ATVC is performed involving the forcible light emission is 500 V and the transferring voltage value $V_{0D}$ in a case where the ATVC is performed involving the unblanking luminescence is 700 V, respectively. In the above case, the following relationships (1) and (2) are established.

$$700=500\times\text{compensation coefficient }\alpha1+\text{compensation intercept }\alpha2 \quad (1)$$

$$1300=1000\times\text{compensation coefficient }\alpha1+\text{compensation intercept }\alpha2 \quad (2)$$

Accordingly, the values of the compensation coefficient α1 and the compensation intercept α1 result, respectively, in a compensation coefficient α1 of 1.2 and a compensation intercept α2 of 100. The engine controller 202 may automatically calculate the compensation coefficient α1 and the compensation intercept α2 by determining each of the plurality of environments and store the calculated compensation coefficient α1 and compensation intercept α2 in a non-volatile memory (not illustrated) to read them out, as desired, when an image is not formed. In this case, the image forming apparatus main body 100 is provided with an environment sensor that can detect a temperature and humidity. The engine controller 202 determines the present environment based on the result detected by the environment sensor to execute the ATVC. Alternatively, the engine controller 202 may measure a plurality of ATVC results under the above described plurality of environments by using a dedicated device or the like preliminary in a production plant and may store the results in a nonvolatile memory held by the engine controller 202. In a case where tendencies of the compensation coefficient α1 and the compensation intercept α2 change according to a resistant value of the transferring roller 110 and/or a print environment (i.e., temperature and humidity), the following configuration is also assumed. Specifically, the engine controller 202 may store a plurality of compensation coefficients α1 and compensation intercepts α1 in a nonvolatile memory to switch the values to be used from the compensation coefficients α1 and the compensation intercepts α2, respectively, depending on the environment.

A description is made below as to a timing chart of an initial operation including the ATVC. FIG. 5 is a timing chart when the ATVC is executed on the surface of the photosensitive member 102 on which the semiconductor laser 103 is forcibly emitted in the present exemplary embodiment.

At timing T502, the engine controller 202 starts the ATVC after a time period before the exposed portion having been subjected to the forcible light emission reaches a position for affecting the detected current, i.e., the transfer nip portion, has passed from timing T501 at which the printing and the forcible light emission is started. Then, the engine controller 202 executes the ATVC described from steps S403 through S405 in the flow chart of FIG. 4 for a predetermined times. At timing T503, when the rotation speed of the scanner motor 104 reaches a predetermined rotation speed assumed at a time of image formation, the engine controller 202 switches an optical system control to the unblanking luminescence. The engine controller 202 terminates the ATVC before the unexposed portion, formed with the semiconductor laser 103 by the unblanking luminescence, of the photosensitive member 102 reaches the transfer nip portion at timing T504. Therefore, a mixture of different surface potential conditions of the photosensitive member 102, which may result in degrading of an accuracy of the ATVC, can be avoided with the timing chart of FIG. 5.

As described above, even in a case where the engine controller 202 executes the ATVC in a state that the exposed portion having been subjected to the forcible light emission reaches a position affecting the detected current, i.e., the transfer nip portion, a suitable electrical setting of the transferring unit can be realized since the compensation coefficient α1 and the compensation intercept α2 are used. Further, since the engine controller 202 can start the ATVC from the timing of the forcible light emission, the reference transferring voltage value can be calculated dramatically earlier than the conventional ATVC. Moreover, a first printer time can be made earlier than the conventional art.

A second exemplary embodiment is described below. In the second exemplary embodiment, the image forming apparatus that acquires more accurate ATVC result is described below. FIGS. 1 through 3 have configurations similar to those of the first exemplary embodiment, so a detailed description thereof is omitted here, other than differences therebetween.

Figure 6:
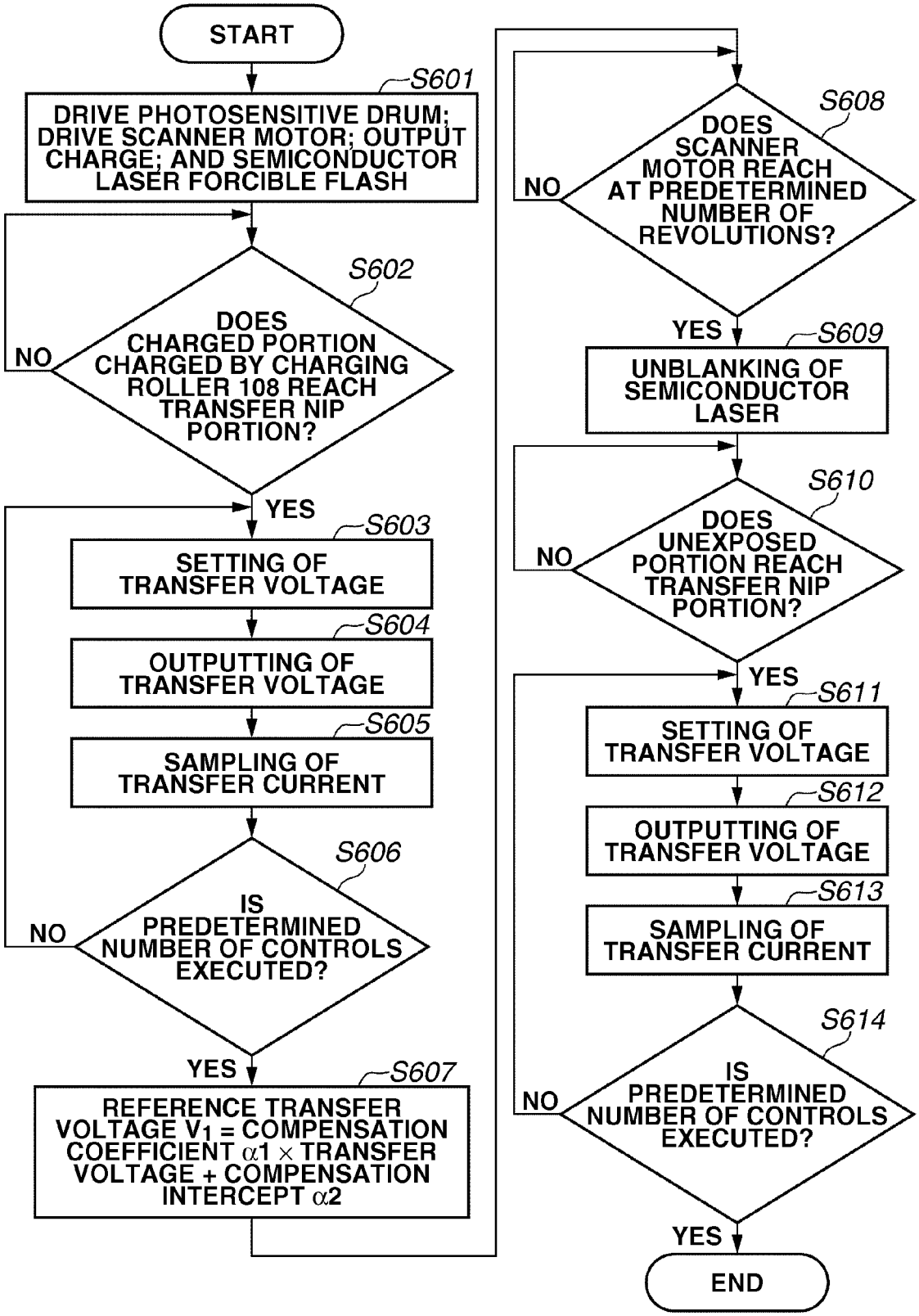
FIG. 6 is another flow chart illustrating an operation including the ATVC of the image forming apparatus when the image forming apparatus is activated.

FIG. 6 is a flow chart illustrating the ATVC processing in a state that the semiconductor laser 103 is forcibly emitted, the exposed portion is formed on the surface of the photosensitive member 102, and the exposed portion reaches the transfer nip portion. The ATVC is executed by the engine controller 202 that functions as the transfer control unit. The processing from step S601 through step S607 is similar to the processing from step S401 through step S407 described in the first exemplary embodiment, so that a detailed description thereof is omitted here and a description is made mainly as to a point unique to the second exemplary embodiment.

In step S608, the engine controller 202 determines whether a rotation of the scanner motor 104 reaches a predetermined number of rotations (i.e., predetermined rotation speed) according to a control of the optical system control unit 204. More specifically, the engine controller 202 detects the rotation speed of the scanner motor 104 according to a detection cycle of the light-receiving sensor 107. In a case where the engine controller 202 determines that the rotation speed of the scanner motor 104 reaches the predetermined rotation speed (YES in step S608), in step S609, the engine controller 202 instructs to start the unblanking luminescence of the semiconductor laser 103.

In step S610, the engine controller 202 starts the ATVC again after a certain time period for starting the unblanking luminescence and for the unexposed portion to reach the transfer nip portion has passed.

In step S611, the engine controller 202 sets the voltage of the transferring roller 110 in a state that the engine controller 202 concurrently performs the unblanking luminescence and the unexposed surface reaches the transfer nip portion (YES in step 610). A tentative reference transferring voltage value initially calculated in step S607 is set by the engine controller 202 in step S611. In step S612, the transferring roller 110 outputs a high voltage according to the setting thereof. In step S613, the engine controller 202 samples the current value flowing through the transferring roller 110 to which a high voltage is applied for a certain period of time. In step S614, the engine controller 202 repeats the above described controls for a predetermined times. If the current value obtained in step S613 is lower than a target current value, the engine controller 202 sets a higher transferring voltage value in the next step S611. On the other hand, if the current value obtained in step S613 is higher than a target current value, the engine controller 202 sets a lower transferring voltage value in the next step S611. After the execution of the controls for the predetermined times (YES in step S614), the engine controller 202 can set the resulting transferring voltage value to the reference transferring voltage value $V_0$. The predetermined number of controls here can be determined, as desired, according to an allowable delay of a first print out.

Figure 7:
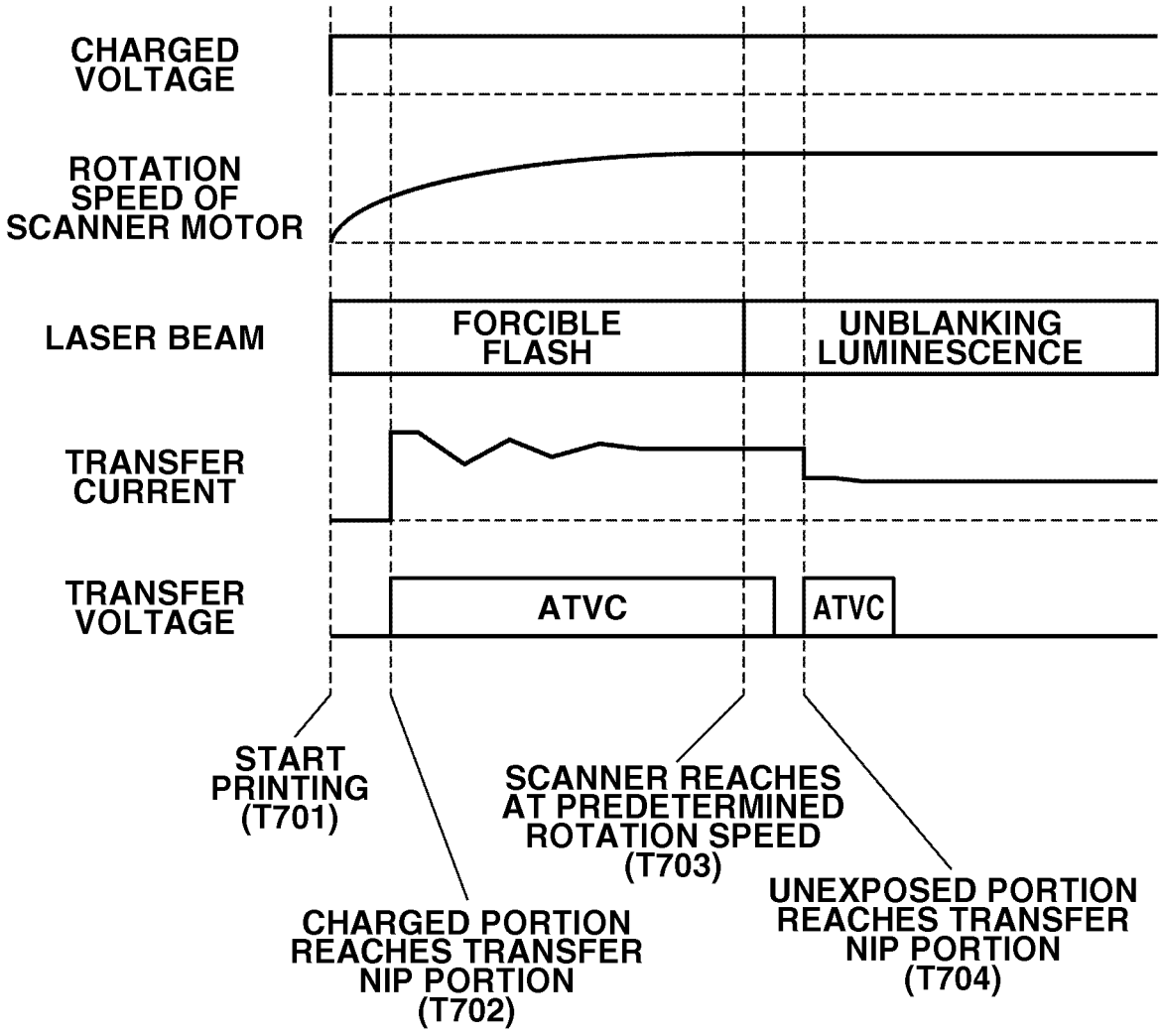
FIG. 7 is another timing chart of an initial operation including the ATVC.

A description is made below as to a timing chart of an initial operation including the ATVC. FIG. 7 is a timing chart when the engine controller 202 executes the ATVC on a surface of the photosensitive member 102 on which the semiconductor laser 103 is forcibly emitted in the present exemplary embodiment. Timings from T701 through T703 are similar to the timings from T501 through T503 illustrated in FIG. 5, so that detailed descriptions thereof are omitted here, other than differences therebetween.

The engine controller executes the ATVC again after the unexposed portion, unexposed due to the start of the unblanking luminescence with the semiconductor laser 103, of the surface of the photosensitive member 102 reaches the transfer nip portion at timing T704. Accordingly, the engine controller 202 can obtain more suitable reference transferring voltage value even if there is a minute gap in the compensation coefficient α1 and the compensation intercept α2 described in the first exemplary embodiment.

As described above, after executing the ATVC concurrently with the forcible light emission, the engine controller 202 switches the processing to the unblanking luminescence and performs the ATVC again in a state that the unexposed portion of the surface of the photosensitive member 102 reaches the transfer nip portion. Accordingly, more suitable reference transferring voltage value when an image is formed can be obtained. The engine controller 202 can obtain the reference transferring voltage earlier than the conventional ATVC since only the final adjustment (i.e., minute adjustment) is executed by the unblanking luminescence.

A third exemplary embodiment is described below. In the above described first and second exemplary embodiments, the values of the transferring voltage obtained in steps S407 and S607, respectively, are corrected to obtain the values of the reference transferring voltage. However, the present invention is not limited to the above configuration. To eliminate a difference of each of the detected currents when the exposed portion and the unexposed portion of the photosensitive member 102 reach the transfer nip portion, the engine controller 202 may correct the detected current value to set the reference transferring voltage at which the corrected current becomes a target current. The target current value at the time may be a value identical to the target current value in the flow charts of FIGS. 4 and 6.

A fourth exemplary embodiment is described below. In the first exemplary embodiment through the third exemplary embodiment, a case that the engine controller 202 corrects the voltage value obtained by the ATVC or a case that the engine controller 202 corrects the detected current value is described. However, the same effect can be produced also by the other method. In the fourth exemplary embodiment, described is a case that the engine controller 202 preliminary sets the target current value in the ATVC so as to eliminate a difference of each of the detected currents when the exposed portion and the unexposed portion of the photosensitive member 102 reach the transfer nip portion. FIGS. 1 through 3 are similar to the first exemplary embodiment, so that detailed descriptions thereof are omitted here, other than differences therebetween.

Figure 8:
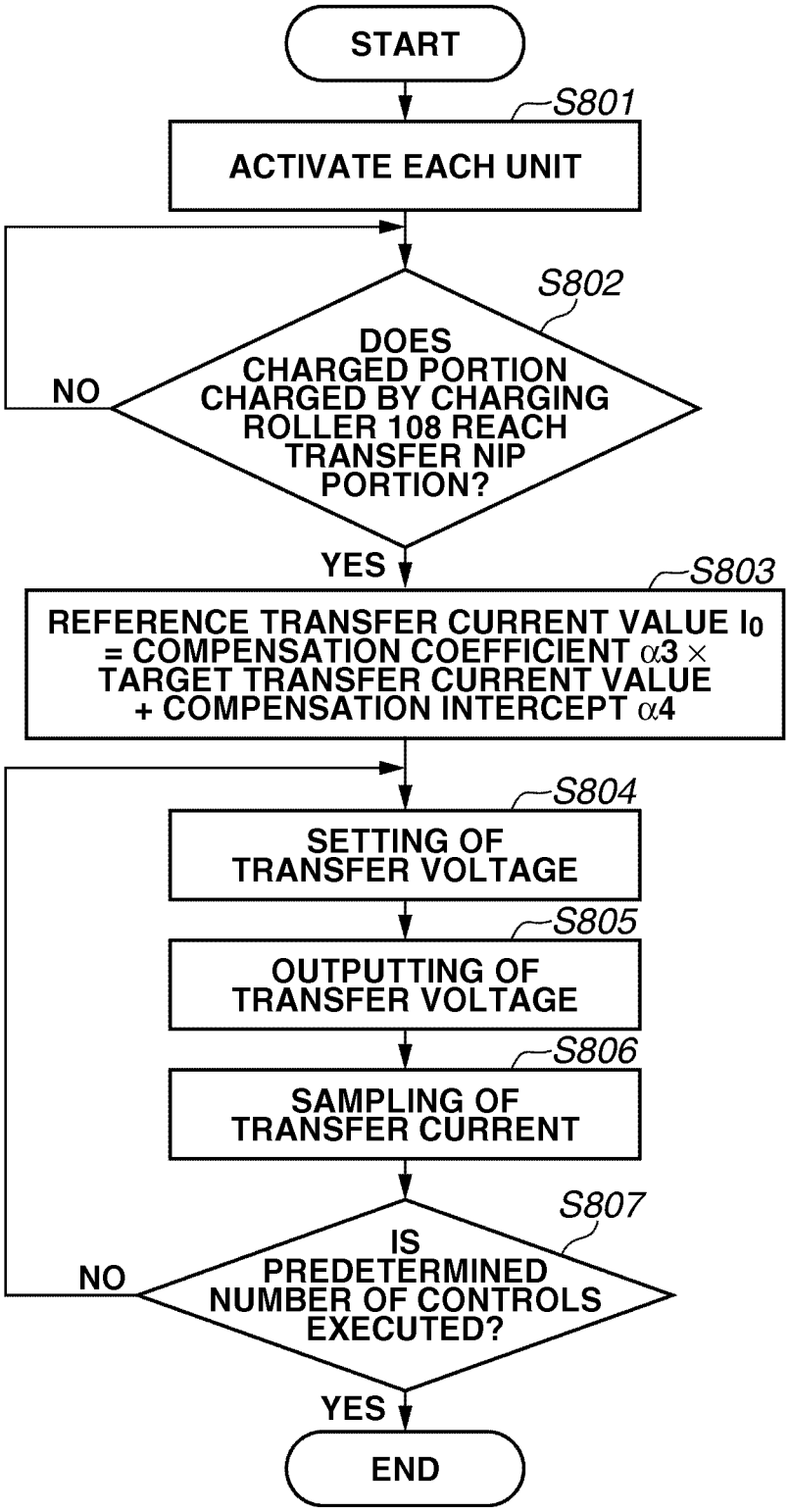
FIG. 8 is further another flow chart of an operation including the ATVC of the image forming apparatus when the image forming apparatus is activated.
Figure 9:
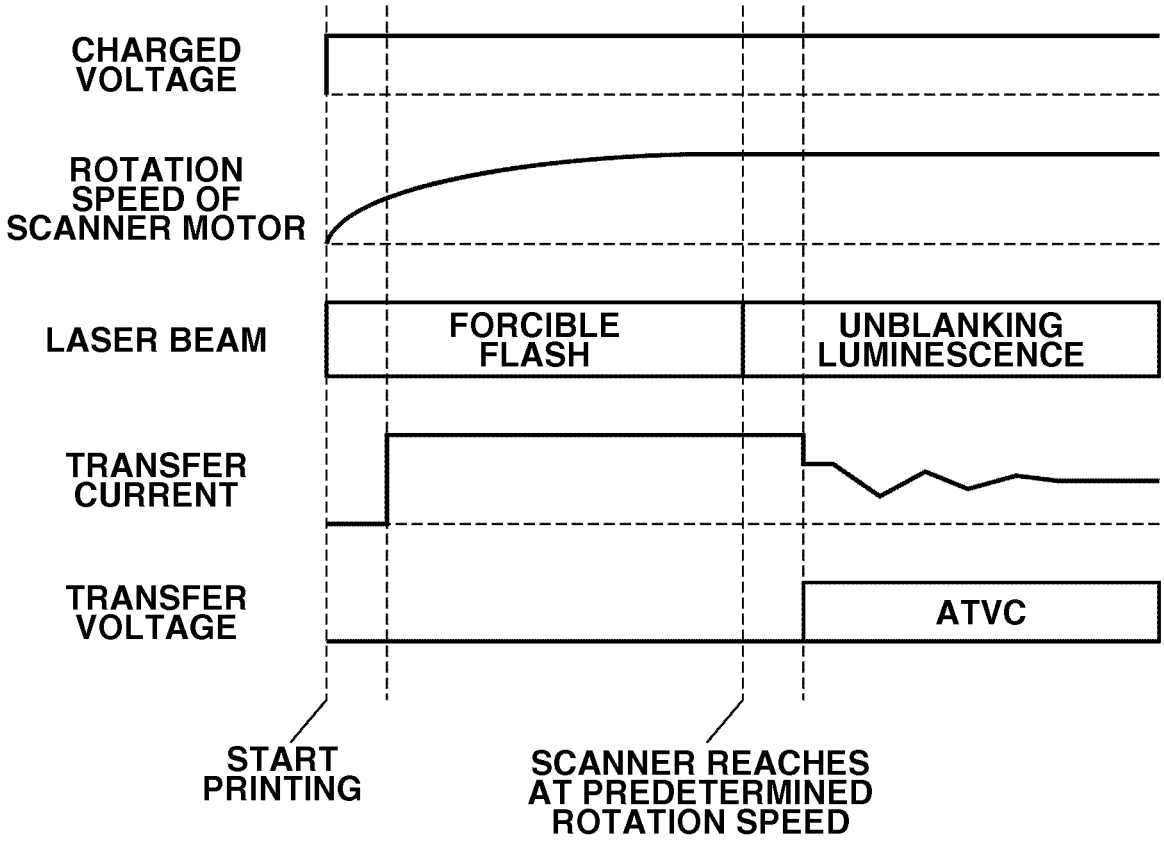
FIG.9 PRIOR ART
FIG. 9 is a timing chart illustrating the conventional ATVC.

FIG. 8 is a flowchart illustrating the ATVC in a state that the semiconductor laser 103 is forcibly emitted, the exposed portion is formed on the surface of the photosensitive member 102, and the exposed portion reaches the transfer nip portion. The flow chart of FIG. 8 is executed by the engine controller 202.

In steps S801 and S802, for example, the processing similar to the processing of steps S401 and S402 of FIG. 4 is performed, and in steps S804, S805, S806 and S807, for example, the processing similar to the processing of steps S403, S404, S405 and S406 of FIG. 4 is performed.

In step S803, the engine controller 202 multiplies the compensation coefficient α3 to the target transfer current value and adds the compensation intercept α4 thereto, thereby obtaining the reference transfer current value $I_0$.

Descriptions are made below as to a compensation coefficient α3 and the compensation intercept α4. The compensation coefficient α3 and the compensation intercept α4 are obtained by the following processing performed by the engine controller 202. Specifically, the engine controller 202 detects a transfer current value $I_{0L}$ when the transferring roller 110 outputs the transferring voltage of a certain value in a state that the charging roller 108 outputs a high voltage of a certain value and the exposed surface, exposed by the forcible light emission with the semiconductor laser 103, of the photosensitive member 102 reaches the transfer nip portion. The engine controller 202 detects a transfer current value $I_{0D}$ when the transferring roller outputs the transferring voltage of a certain value in a state that the charging roller 108 outputs the high voltage of a certain value and the unexposed surface, unexposed by the unblanking luminescence with the semiconductor laser 103, of the photosensitive member 102 reaches the transfer nip portion. The engine controller 202 obtains the compensation coefficient α3 and the compensation intercept α4 based on the detected transfer current value $I_{0L}$ and transfer current value $I_{0D}$. A specific example of the above is described below.

It is assumed that the engine controller 202 detects that the transfer current value $I_{0L}$ is 2 uA in a state that the transferring voltage is 500 V and the exposed portion exposed by the forcible light emission reaches the transfer nip portion in the low-temperature-and-low-humidity environment. Similarly, it is assumed that the engine controller 202 detects that the transfer current value $I_{0D}$ is 4 uA in a state that the transferring voltage is 500 V and the unexposed portion unexposed by the unblanking luminescence reaches the transfer nip portion in the low-temperature-and-low-humidity environment. Further, it is assumed that the engine controller 202 detects that the transfer current values $I_{0L}$ and $I_{0D}$ are 6 uA and 9 uA, respectively, in a state that, similarly, the transferring voltage is 500 V in the high-temperature-and-high-humidity environment. The following relationships (3) and (4) are established.

$$4 = 2 \times \text{compensation coefficient } \alpha 3 + \text{compensation intercept } \alpha 4 \quad (3)$$

9=6×compensation coefficient α3+compensation intercept α4 (4)

Accordingly, the values of the compensation coefficient α3 and the compensation intercept α4 result, respectively, in a compensation coefficient α3 of 1.25 and a compensation intercept α4 of 1.5. How to obtain the compensation coefficient α3 and the compensation intercept α4 is similar to the cases of the compensation coefficient α1 and the compensation intercept α1 as described above in the first exemplary embodiment. In a case where tendencies of the compensation coefficient α3 and the compensation intercept α4 change according to the resistant value of the transferring roller 110 and the print environment (i.e., temperature and humidity), the following configurations are also assumed. Specifically, the engine controller 202 may store a plurality of compensation coefficients α3 and a plurality of compensation intercepts α4 in the nonvolatile memory so as to switch the compensation coefficients α3 and the compensation intercepts α4 to be used, respectively, according to the environments.

As described above, an effect similar to those of the first and second exemplary embodiments can be produced by also changing the target current value in the ATVC.

In a flow chart of FIG. 8, the processing described in step S608 and the following steps of the flow chart of FIG. 6 is not performed. However, the engine controller 202 may execute the processing of step S608 and the following steps of FIG. 6 after executing the flow chart of FIG. 8. In this case, the engine controller 202 may execute the processing in step S608 and the following steps provided that a reference transferring voltage value calculated in the flowchart of FIG. 8 is set to a value of the tentative transferring voltage of step S607.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-235562 filed Oct. 20, 2010, which is hereby incorporated by reference herein in its entirety.

What is claimed is:

1. An image forming apparatus including:

a light emitter configured to emit a light beam;

a polygon mirror configured to scan a surface of a photosensitive member that is charged with the light beam emitted from the light emitter by a charging unit to form an electrostatic latent image on the photosensitive member;

a detector configured to detect the light beam to be used in scanning by the polygon mirror;

a developer unit configured to visualize a toner image by causing a toner to adhere to an electrostatic latent image formed on a surface of the photosensitive member;

a transferring unit configured to transfer the toner image to a transferred medium at a transfer nip portion;

a transferring voltage applying unit configured to apply a transferring voltage to the transferring unit; and a transferring controller configured to detect a current flowing through the transferring unit according to the application of the transferring voltage to determine the transferring voltage to be applied to the transferring unit based on the detection result; the image forming apparatus further comprising:

a measuring unit configured to cause the light emitter to forcibly emit continuously through an image region of the photosensitive member and a non-image region when the polygon mirror is activated to measure a speed of the polygon mirror based on a detection cycle of the detector;

wherein the transferring controller determines a reference transferring voltage by correcting the transferring voltage at which detected current becomes a target current in a state that the light emitter is forcibly emitted when the polygon mirror is activated, such that a difference of each of the detected currents when an exposed portion and an unexposed portion of the photosensitive member reach the transfer nip portion is eliminated.

2. The image forming apparatus according to claim 1, wherein the transferring controller detects a current flowing through the transferring unit according to an application of the transferring voltage according to timing at which the exposed portion, formed by the forcible light emission, of the photosensitive member reaches the transfer nip portion.

3. The image forming apparatus according to claim 1, wherein the transferring controller is configured, after determining the reference transferring voltage, to apply the reference transferring voltage to the transferring unit when the unexposed portion of the photosensitive member reaches the transfer nip portion, to control the detected current so that the detected current becomes the target current, and to set the transferring voltage at which the detected current becomes the target current to a final reference transferring voltage.

4. An image forming apparatus including:

a light emitter configured to emit a light beam;

a polygon mirror configured to scan a surface of a photosensitive member to which a light beam emitted from the light emitter is charged by a charging unit to form an electrostatic latent image on the photosensitive member;

a detector configured to detect the light beam scanned by the polygon mirror;

a developer unit configured to visualize a toner image by causing a toner to adhere to an electrostatic latent image formed on a surface of the photosensitive member;

a transferring unit configured to transfer the toner image to a transferred medium at a transfer nip portion;

a transferring voltage application unit configured to apply a transferring voltage to the transferring unit; and a transferring controller configured to detect a current flowing through the transferring unit according to an application of the transferring voltage and to determine the transferring voltage to be applied to the transferring unit based on the detection result; the image forming apparatus further comprising:

a measuring unit configured to cause the light emitter to forcibly emit continuously through an image region of the photosensitive member and a non-image region when the polygon mirror is activated to measure a speed of the polygon mirror based on a detection cycle of the detector;

wherein the transferring controller sets a target current in a state that a light emitter is forcibly emitted when the polygon mirror is activated so as to eliminate a difference of each of the detected currents when an exposed portion and an unexposed portion of the photosensitive member reach the transfer nip portion; and wherein the transferring controller determines a reference transferring voltage at which the detected current becomes the set target current.

5. The image forming apparatus according to claim 4, wherein the transferring controller detects a current flowing through the transferring unit according to an application of the transferring voltage according to timing at which the exposed portion, formed by the forcible light emission, of the photosensitive member reaches the transfer nip portion.

6. An image forming apparatus including:

a light emitter configured to emit a light beam;

a polygon mirror configured to scan a surface of a photosensitive member that is charged with the light beam emitted from the light emitter by a charging unit to form an electrostatic latent image on the photosensitive member;

a detector configured to detect the light beam to be used in scanning by the polygon mirror;

a developer unit configured to visualize a toner image by causing a toner to adhere to an electrostatic latent image formed on a surface of the photosensitive member;

a transferring unit configured to transfer the toner image to a transferred medium at a transfer nip portion;

a transferring voltage applying unit configured to apply a transferring voltage to the transferring unit; and a transferring controller configured to detect a current flowing through the transferring unit according to the application of the transferring voltage to determine the transferring voltage to be applied to the transferring unit based on the detection result; the image forming apparatus further comprising:

a measuring unit configured to cause the light emitter to forcibly emit continuously through an image region of the photosensitive member and a non-image region when the polygon mirror is activated to measure a speed of the polygon mirror based on a detection cycle of the detector;

wherein the transferring controller corrects the detected current and determines transferring voltage at which the corrected current becomes the target current as a reference transferring voltage in a state that the light emitter is forcibly emitted when the polygon mirror is activated, such that a difference of each of the detected currents when an exposed portion and an unexposed portion of the photosensitive member reach the transfer nip portion is eliminated.

7. The image forming apparatus according to claim 6, wherein the transferring controller detects a current flowing through the transferring unit according to an application of the transferring voltage according to timing at which the exposed portion, formed by the forcible light emission, of the photosensitive member reaches the transfer nip portion.

8. The image forming apparatus according to claim 6, wherein the transferring controller is configured, after determining the reference transferring voltage, to apply the reference transferring voltage to the transferring unit when the unexposed portion of the photosensitive member reaches the transfer nip portion, to control the detected current so that the detected current becomes the target current, and to set the transferring voltage at which the detected current becomes the target current to a final reference transferring voltage.

9. An image forming apparatus including:

a light emitter configured to emit a light beam;

a polygon mirror configured to scan a surface of a photosensitive member that is charged with the light beam emitted from the light emitter by a charging unit to form an electrostatic latent image on the photosensitive member;

a detector configured to detect the light beam to be used in scanning by the polygon mirror;

a transferring unit configured to transfer the toner image to a transferred medium at a transfer nip portion;

a transferring controller configured to detect a current flowing through the transferring unit when a transferring voltage is applied to the transferring unit; and a light emitter controller configured to control light emission from the light emitter, the light emitter controller performing forcible light emission by causing the light emitter to continuously emit a light beam to an image region on a photosensitive member and a non-image region, wherein the transferring controller is configured to obtain a reference transferring voltage by applying the transferring voltage to the transferring unit and detecting a current flowing through the transferring unit while an exposed portion of the photosensitive member formed by the forcible light emission is at the transfer nip portion, adjusting the transferring voltage so that the detected current becomes a target current, and correcting a transferring voltage applied when the detected current becomes the target current.

10. The image forming apparatus according to claim 9, wherein the transferring controller is configured to correct the transferring voltage based on a predetermined correction coefficient, and wherein the predetermined coefficient is changeable based on an environment.

11. The image forming apparatus according to claim 9, wherein the reference transferring voltage is a reference for a voltage applied to the transferring unit when the toner image is transferred to the transferred medium.

12. The image forming apparatus according to claim 9, wherein the transferring controller is configured to apply the reference transferring voltage to the transferring unit and detect a current flowing through the transferring unit while an unexposed portion of the photosensitive member is at the transfer nip portion, adjust the transferring voltage so that the detected current becomes a target current, and set a transferring voltage applied when the detected current becomes the target current to a final reference transferring voltage.

13. The image forming apparatus according to claim 12, wherein the reference transferring voltage is a reference for a voltage applied to the transferring unit when the toner image is transferred to the transferred medium.

14. An image forming apparatus including:

a light emitter configured to emit a light beam;

a polygon mirror configured to scan a surface of a photosensitive member that is charged with the light beam emitted from the light emitter by a charging unit to form an electrostatic latent image on the photosensitive member;

a detector configured to detect the light beam to be used in scanning by the polygon mirror;

a transferring unit configured to transfer the toner image to a transferred medium at a transfer nip portion;

a transferring controller configured to detect a current flowing through the transferring unit when a transferring voltage is applied to the transferring unit; and a light emitter controller configured to control light emission from the light emitter, the light emitter controller performing forcible light emission by causing the light emitter to continuously emit a light beam to an image region on a photosensitive member and a non-image region, wherein the transferring controller is configured to apply the transferring voltage to the transferring unit and detect a current flowing through the transferring unit while an exposed portion of the photosensitive member formed by the forcible light emission is at the transfer nip portion, correct the detected current, adjust the transferring voltage so that the corrected current becomes a target current, and set a transferring voltage applied when the corrected current becomes the target current to the reference transferring voltage.

15. The image forming apparatus according to claim 14, wherein the transferring controller is configured to correct the current based on a predetermined correction coefficient, and wherein the predetermined coefficient is changeable based on an environment.

16. The image forming apparatus according to claim 14, wherein the reference transferring voltage is a reference for a voltage applied to the transferring unit when the toner image is transferred to the transferred medium.

17. The image forming apparatus according to claim 14, wherein the transferring controller is configured to apply the reference transferring voltage to the transferring unit and detect a current flowing through the transferring unit while an unexposed portion of the photosensitive member is at the transfer nip portion, adjust the transferring voltage so that the detected current becomes a target current, and set a transferring voltage applied when the detected current becomes the target current to a final reference transferring voltage.

18. The image forming apparatus according to claim 17, wherein the reference transferring voltage is a reference for a voltage applied to the transferring unit when the toner image is transferred to the transferred medium.

19. An image forming apparatus including:

a light emitter configured to emit a light beam;

a polygon mirror configured to scan a surface of a photosensitive member that is charged with the light beam emitted from the light emitter by a charging unit to form an electrostatic latent image on the photosensitive member;

a detector configured to detect the light beam to be used in scanning by the polygon mirror;

a transferring unit configured to transfer the toner image to a transferred medium at a transfer nip portion;

a transferring controller configured to detect a current flowing through the transferring unit when a transferring voltage is applied to the transferring unit; and a light emitter controller configured to control light emission from the light emitter, the light emitter controller performing forcible light emission by causing the light emitter to continuously emit a light beam to an image region on a photosensitive member and a non-image region, wherein the transferring controller is configured to determine the reference transferring voltage by applying the transferring voltage to the transferring unit and detecting a current flowing through the transferring unit while an exposed portion of the photosensitive member formed by the forcible light emission is at the transfer nip portion and by applying the transferring voltage to the transferring unit and detecting a current flowing through the transferring unit while an unexposed portion of the photosensitive member is at the transfer nip portion.

20. The image forming apparatus according to claim 19, wherein the reference transferring voltage is a reference for a voltage applied to the transferring unit when the toner image is transferred to the transferred medium.

* * * * *